United States Patent [19]

Diehl et al.

[11] Patent Number: 4,671,887

[45] Date of Patent: Jun. 9, 1987

[54] AQUEOUS STABLE SUSPENSIONS OF WATER INSOLUBLE SILICATES CAPABLE OF BINDING CALCIUM IONS AND THEIR USE FOR THE PRODUCTION OF WASHING AND CLEANING AGENTS

[75] Inventors: Manfred Diehl, Frankfurt; Roland Bergmann, Grobkrotzenburg; Gunter Stadtmuller; Sigrid Diener, both of Alzenau, all of Fed. Rep. of Germany

[73] Assignee: Degussa Aktiengesellschaft, Frankfurt am Main, Fed. Rep. of Germany

[21] Appl. No.: 804,140

[22] Filed: Dec. 3, 1985

[30] Foreign Application Priority Data

Dec. 5, 1984 [DE] Fed. Rep. of Germany ..... 3444311

[51] Int. Cl.[4] ..... C11D 1/72; C11D 3/12; C11D 7/02

[52] U.S. Cl. ..... 252/174.25; 252/131; 252/140; 252/173; 252/179; 252/DIG. 14; 423/328

[58] Field of Search ..... 252/174.25, 173, DIG. 14, 252/140, 131, 179, DIG. 11; 423/328

[56] References Cited

U.S. PATENT DOCUMENTS

| | | | |
|---|---|---|---|
| 4,072,622 | 2/1978 | Kühling et al. | 252/179 |
| 4,073,867 | 2/1978 | Roebke et al. | 423/429 |
| 4,271,135 | 6/1981 | Wuest et al. | 423/429 |
| 4,280,920 | 7/1981 | Garvey et al. | 252/173 |
| 4,303,626 | 12/1981 | Strack et al. | 423/329 |
| 4,303,627 | 12/1981 | Strack et al. | 423/329 |
| 4,303,628 | 12/1981 | Strack et al. | 423/329 |
| 4,305,916 | 12/1981 | Strack et al. | 423/329 |
| 4,405,483 | 9/1983 | Kuzel et al. | 252/140 |
| 4,438,012 | 3/1984 | Kühling et al. | 252/131 |
| 4,486,331 | 12/1984 | Diehl et al. | 252/174.25 |
| 4,529,541 | 7/1985 | Wilms et al. | 252/526 |

FOREIGN PATENT DOCUMENTS

| | | |
|---|---|---|
| 2412837 | 10/1974 | Fed. Rep. of Germany . |
| 2527388 | 4/1976 | Fed. Rep. of Germany . |
| 2447021 | 5/1976 | Fed. Rep. of Germany . |
| 2517218 | 10/1976 | Fed. Rep. of Germany . |
| 2615698 | 10/1977 | Fed. Rep. of Germany . |
| 2633463 | 2/1978 | Fed. Rep. of Germany . |
| 2651420 | 5/1978 | Fed. Rep. of Germany . |
| 2651436 | 5/1978 | Fed. Rep. of Germany . |
| 2651437 | 5/1978 | Fed. Rep. of Germany . |
| 2651485 | 5/1978 | Fed. Rep. of Germany . |
| 2652419 | 5/1978 | Fed. Rep. of Germany . |
| 2651445 | 5/1978 | Fed. Rep. of Germany . |
| 3209631 | 9/1983 | Fed. Rep. of Germany . |

*Primary Examiner*—Prince E. Willis

*Attorney, Agent, or Firm*—Cushman, Darby & Cushman

[57] ABSTRACT

There is prepared an aqueous stable suspension of a water insoluble silicate capable of binding calcium ions and it is used for the production of washing and cleaning agents. The suspension contains in addition to water components A and B wherein component A is a silicate capable of binding calcium and having the formula $$(Cat_{2/n}O)_x - Me_2O_3 \cdot (SiO_2)_y \qquad \text{I}$$

and component B is a dispersing agent comprising a mixture of at least two fatty alcohols polyglycol ether based on isotridecyl alcohol or another aliphatic $C_{13}$ alcohol and ethylene oxide having the following properties:

(a) Fatty alcohol polyglycol ether having 4.5 to 5.5 EO units

| | |
|---|---|
| Turbidity point DIN 53917 | 56 to 60° C. |
| Solidification point | +4 to −25° C. |
| Viscosity at 50° C. | 13 to 28 m Pas |
| Density at 50° C. | 0.94 to 0.96 g/ml |

(b) Fatty alcohol polyglycol ether having 6 to 8 EO units

| | |
|---|---|
| Turbidity point DIN 53917 | 66 to 74° C. |
| Solidification point | +12 to −16° C. |
| Viscosity at 50° C. | 18 to 28 m Pas |
| Density at 50° C. | 0.96 to 0.98 g/ml |

20 Claims, No Drawings

AQUEOUS STABLE SUSPENSIONS OF WATER INSOLUBLE SILICATES CAPABLE OF BINDING CALCIUM IONS AND THEIR USE FOR THE PRODUCTION OF WASHING AND CLEANING AGENTS

BACKGROUND OF THE INVENTION

There has already been proposed a process for washing and cleaning solid materials, especially textiles, as well as suitable washing and cleaning agents for carrying out the process in which the function (builder) of the calcium complex binding phosphate is replaced entirely or partially by finely divided, generally bound water containing, water insoluble aluminum silicates capable of binding calcium (see German OS No. 2412837).

Thereby, it is a matter of compounds of the general formula I $$(Cat_{2/n}O)_x—Me_2O_3\cdot(SiO_2)_y \qquad I$$

in which Cat is a cation of valence n capable of exchanging with calcium, x is a number from 0.7 to 1.5, M is aluminum and y is a number from 0.8 to 6, preferably 1.3 to 4.

As cation there is preferably employed sodium but this can also be replaced by lithium, potassium, ammonium, or magnesium.

The above defined compounds capable of binding calcium in the following description for simplicity are called "aluminum silicate". This is also true for the preferably used sodium aluminum silicates, true for all additives made for the use of the invention and the total additives over whose production and properties correspond to the totality of all the above defined compounds.

The aluminum silicate especially suited for employment in washing and cleaning agents have a calcium binding capacity of preferably 50 to 200 mg CaO/g of the water free aluminum silicate. In the following when reference is made to water-free aluminum silicate there is meant the condition of the aluminum silicate which is reached after drying for one hour at 800° C. In this drying there is removed practically completely both the adhering and the bound water.

In the production of washing or cleaning agents, in which besides the customary components of this type of agent there is present the abovedefined aluminum silicate, there is advantageously employed as starting material aluminum silicates which are moist, for example still moist from their production. Thereby there is mixed the moist compounds with at least one part of the remaining components of the agent being produced and the mixture is converted through known procedures such as for example spray drying into the finished washing or cleaning agent as final product, for example into a pourable product.

In the framework of the precedingly sketched process for the production of washing or cleaning agents the aluminum silicate is supplied or employed inter alia in the form of an aqueous suspension. Since transportation is carried out inter alia over long distances specific requirements are placed on the suspension properties, such as e.g. suspension stability and pumpability, of the aluminum silicate dispersed in the aqueous phase.

It is known to use alkylphenol ethylene adducts to stabilize aluminum silicate suspensions (German Patent OS No. 2615698, German Patent OS No. 3209631). There is attained a solids content of 50% and over.

Furthermore there are known suspensions which contain beside the alkali aluminum silicate as a stabilizer ethoxylation products containing 10 to 20 carbon atoms, preferably being ethxylation products of unsaturated alcohols with 1 to 8 ethylene oxide units per mole of the alcohol (German Patent OS No. 2527388, German Patent OS No. 2651698). With the dispersion agents of the last mentioned published applications previously there could only be reached a maximum solids concentration in the suspension of 38 wt. %.

SUMMARY OF THE INVENTION

It has now been found that specific mixtures of alkyl alcohol ethoxylates of specific properties have the ability to stablize suspensions of calcium binding aluminum silicates of this type, that these are stable for a long time and even after standing are still pumpable without problem.

The invention is directed to an aqueous pumpable, stable suspension of a water insoluble silicate capable of binding calcium ions which contains a dispersing component which contains in addition to water based on the total weight of the aqueous suspensions:

(A) as water insoluble silicate capable of binding calcium 0.5 to 70 weight % of a finely divided, bound water containing, synthetically produced, water insoluble crystalline compound of the formula $$(Cat_{2/n}O)_x—Me_2O_3\cdot(SiO_2)_y \qquad I$$

in which Cat is a cation of valence n exchangeable with calcium, x is a number from 0.7 to 1.5, Me is boron or aluminum and y is a number from 0.8 to 6, and (B) as a dispersing component in an amount of 0.5 to 6 weight percent a mixture of at least two different fatty alcohol polyglycol ethers based on isotridecyl alcohol or another aliphatic $C_{13}$ alcohol and ethylene oxide having the following properties (a) Fatty alcohol polyglycol ether having 4.5 to 5.5 EO units

| | |
|---|---|
| Turbidity point DIN 53917 | 56 to 60° C. |
| Solidification point | +4 to −25° C. |
| Viscosity at 50° C. | 13 to 28 m Pas |
| Density at 50° C. | 0.94 to 0.96 g/ml |

(b) Fatty alcohol polyglycol ether having 6to 8 EO units

| | |
|---|---|
| Turbidity point DIN 53917 | 66 to 74° C. |
| Solidification point | +12 to −16° C. |
| Viscosity at 50° C. | 18 to 28 m Pas |
| Density at 50° C. | 0.96 to 0.98 g/ml |

In the suspension of the invention component A can be crystalline.

In formula I in component A y can be a number from 1.3 to 4.

In a preferred form of the invention the crystalline component A can be a zeolite of Type A.

In addition to water the previously mentioned compounds are the essential components of the suspension of the invention. However, it can also contain further components, thus, e.g. foam suppressants, additives or so-called dissolving intermediaries, i.e. compounds which improve the solubility of the dispersing agent employed in the aqueous phase. As foam suppressants there can be employed the customary foam suppressing materials for example, foam suppressing soaps, silicone defoamers, foam suppressing triazine derivatives, all of which are well known to those skilled in the art. This type of additive generally is not necessary. However, with foaming dispersing agents it can be desired, especially with higher amounts of alkylbenzenesulfonic acids.

Also there is generally no need to add solvent intermediary materials, but these can be indicated if the suspension according to the invention contains as stabilizing agent a hydrophilic, but low water soluble colloid such as for example polyvinyl alcohol. Advantageously there is employed e.g. a solvent intermediary, dimethyl sulfoxide is very well suited if the concentration of a stabilizing agent only slightly soluble in water is higher than about 1%. The portion of the solvent intermediary based on the entire suspension for example can be of the same order of magnitude as the portion of stabilizing agent. Further compounds suitable as solvent intermediaries are generally known to those skilled in the art; hydrotropic agents such as for example benzenesulfonic acid, toluenesulfonic acid, xylenesulfonic acid or the water soluble salts thereof (e.g. the sodium or potassium salts) as well as octyl sulfate are suitable.

In total additives for the "concentration of aluminum silicate" to the "solids content" or to the content of "active substance" (=A—S) reference is made to the condition of the aluminum silicate which is reached after one hour drying at 800° C. In this drying both the adhering and the bound water is practically completely removed.

The aluminum silicates can be naturally occurring or can be synthetically produced products, in which case the synthetically produced products are preferred. They can be produced, e.g. by reaction of water soluble silicates with water soluble aluminates in the presence of water. For this purpose aqueous solutions of the starting materials can be mixed with each other or one component present in solid condition can be reacted with the other component present as an aqueous solution. The desired aluminum silicate can also be obtained by mixing both components present in the solid state in the presence of water. The aluminum silicate can also be made from $Al(OH)_3$, $Al_2O_3$ or $SiO_2$ by reaction with alkali silicate, respectively alkali aluminate solutions. The production can also be carried out according to additional known processes. The invention especially relates to aluminum silicates which have a three dimensional spatial lattice structure.

The preferred aluminum silicate (AS) having a calcium binding capacity in the range of 100 to 200 mg CaO/g, for the most part at about 100 to 180mg CaO/g above all are found in compounds of the composition.

$$0.7—1.1\ Na_2O \cdot Al_2O_3 \cdot 1.3—3.3\ SiO_2$$

This summation formula includes two types of different crystal structures (respectively their non-crystalline fore-products), which also differ in their summation formulae. They are as follows $$0.7—1.1\ Na_2O \cdot Al_2O_3 \cdot 1.3—2.4\ SiO_2 \quad (1)$$

$$0.7—1.1\ Na_2O \cdot Al_2O_3 \cdot 2.4—3.3\ SiO_2 \quad (2)$$

The different crystal structures are seen in the X-ray diffraction pattern.

The crystalline aluminum silicate present in aqueous suspension can be separated off from the remaining aqueous solution by filtration and dried. Depending on the drying conditions the product contains more or less bound water. However, the aluminum silicate after its production in general does not need to be dried to manufacture a suspension according to the invention, rather, and this is especially preferred, an aluminum silicate still moist from its production can be used.

The particle size of the individual aluminum silicate particles can be different and e.g. be in the range between 0.1μ and 0.1 mn. This data refers to the primary particle size i.e. the size of particles accumulating in the precipitation and in a given case, the subsequent crystallization. There are used with especial advantage aluminum silicates in which at least 80 wt. % of the particle consist of a size of 10 to 0.01 μm, especially from 8 to 0.1 μm.

Preferably this aluminum silicate contains no primary or secondary particles having an average diameter above 45 μm. As secondary particles there is meant particles which are formed by agglomeration of primary particles to larger structures.

In regard to the agglomeration of primary particles to larger structures, the use of aluminum silicate still moist from its production has proven especially advantageous for the production of the suspensions according to the invention, since it has proven that the use of this still wet product practically completely stops the formation of secondary particles.

In a specially preferred form of the invention there is employed as component A powdery zeolite of Type A with a specially defined particle spectrum.

This type of zeolite powder can be produced according to German Patent OS No 2447021 (and related Roebke U.S. application Ser. No. 471,898, filed Mar. 3, 1983, German Patent OS No. 2517218 and related Roebke U.S. Pat. No. 4,073,867, German Patent OS No. 2651419 and related Strack U.S. Pat. No. 4,303,628, German Patent OS No. 2651436 and related Strack U.S. Pat. No. 4,305,916, German Patent OS No. 2651437 and related Strack U.S. Pat. No. 4,303,627, German Patent OS No. 2651445, German Patent OS No. 2651485 and related U.S. Pat. No. 4,303,629 and which have the particle size distribution stated there. The entire disclosure of the cited Roebke U.S. application and U.S. patent and of the cited Strack U.S. patents are hereby incorporated by reference and relied upon. Similarly the entire disclosure of German Patent OS No. 2651445 is incorporated by reference and relied upon.

Preferably there is a zeolite powder of Type A according to German Patent OS No. 2651485 and the related Strack U.S. Pat. No. 4,303,629.

The zeolites of the just cited patents and applicants have the particle distribution curves referred to therein.

The concentration of the aluminum silicate, especially of the powdery zeolites of Type A preferably can be 44 to 53 wt. % (and more), especially 46 to 52 wt. % based on the suspension.

Component B, the dispersingly active component, consists of (or consists essentially of) a mixture of at least two different fatty alcohol polyglycol ethers. The mixing ratio of these fatty alcohol polyglycol ethers can be varied as desired. If not more than two fatty alcohol ethers are employed the preferred mixing ratio is 7:3 to 2:8, i.e. 7 parts ether (a) to 3 parts ether (b) up to 2 parts of ether (a) to 8 parts of ether (b) of formula B.

In an especially preferred form of the invention the mixing ratio is 1:1.

The concentration of component B in the aqueous suspension, based on the suspension, is preferably from 1 to 2 wt. %, especially 1.4 to 1.6 wt. %. This concentration is sufficient to stabilize a suspension having a solids content of 50 wt. % and more.

The suspension of the invention has the advantage that it is sedimentation stable and of a pumpable consistency in the temperature range of 10° to 50° C.

Furthermore, it is advantageous that component B be liquid at room temperature and therefore need not be heated.

It is of especial advantage that in the suspension of the invention there can be reached clearly higher solids content of up to 53 wt. % based on the zeolite dried at 800° C.

Basically the aqueous suspensions of the invention made of the mentioned components A and B and in a given case, made of the starting materials for the production of these components can still contain remaining materials as well as additional components in comparatively small amounts. If further processing of the suspension to washing and cleaning agents is intended then it is a matter of the additional materials present being materials which are suitable as components of washing and cleaning agents.

A reference point for the stability of the suspension of the invention is given by a simple test in which the aluminum silicate suspension of the desired concentration is produced and contains a dispersing agent according to the invention and optionally additional materials, for example washing agent components such as penta sodium phosphate in various amounts. The influence of the added material on the settling behavior of the suspension can then be observed visually. After standing 24 hours the suspension should in general at the most be so far settled that the superfluent clear or silicate particle free solution not make up more than 20%, preferably not more than (10%), especially not more than 6% of the total height. In general the amount of additive materials should be limited to the extent that the suspension can be repumped again without problem into the supply containers and tubes respectively loop lines after 12 hours, preferably after 24 hours and especially after 48 hours. The settling behavior of the suspensions, in a given case containing additional components, is examined at room temperature at a total height of the suspension of 10 cm. They are pumpable without problem even after 4 to 8 days. These data also give only a reference point to the stability of the suspension. It depends in each individual case, upon which suspension stability is established. In using the suspension of the invention as stock suspension for long storage in a reservoir from which it can be drawn off by pumping as required, it can be suitable to hold small the portion of other components for example of washing and cleaning agents, or even to eliminate those entirely.

The suspension can be produced through simple mixing of its components, in which case the aluminum silicate can be added e.g. as such or, in a given case, already wet from its production, or in aqueous suspension. It is especially advantageous to stir component B into the aluminum silicate still wet from its production, which aluminum silicate can be present e.g. as filter cake.

However, it goes without saying there can also be employed already dried aluminum silicate, i.e. freed from adhering water, in a given case still containing bound water.

The suspension of the invention is distinguished by high stability. Above all, it exhibits in the low temperature range a low viscosity, which clearly is below the viscosity of known suspensions. Thereby with the suspensions of the invention rheopex flow behavior is increased. Its stabilizing effect is especially valuable with aluminum silicates having particle sizes of 5 to 30 μm. It is pumpable so that it makes possible a simple handling of moist aluminum silicate. Even after long interruptions in the pumping process the suspension is pumpable without problem. Because of its high stability the suspension is also transportable in customary tank and kettle wagons without fear or forming unusable of disturbing residues. Thereby the suspension is outstandingly suitable as a form of supply of aluminum silicates for supplying to, for example, manufacturers of washing agents.

The suspension can be stored at room temperature or also at higher temperatures, and be conveyed by pipe lines, pumps or otherwise. For the most part the handling of the suspension is at a temperature between room temperature (most preferred) and about 50° C.

The suspension of the invention is especially suited for further processing into dry appearing, bulk or pourable products. Thus for example for the production of powdery water softening agents, e.g. by spray drying. Therewith the suspension is of considerable significance in the production of powdery washing agents. There do not occur any lasting residues in the supply of the aqueous suspension to the drying apparatus. Furthermore, it has been shown that the suspension of the invention makes possible processing to extraordinarily dust free products.

Because of its especial stability the suspension of the invention is already usable as such, i.e. without further processing with or without further washing, bleaching and/or cleaning additives, for example as water softening agent, washing or cleaning agent and especially as liquid scouring agent having increased suspension stability.

An especially important use of the suspension is the further processing to dry appearing bulk or pourable washing and cleaning agent which contain further compounds in addition to the suspension components.

The suspension of the invention is especially suitable for the production of powdery washing and cleaning agents.

As a starting point for the production of this agent there is used an aqueous, flowable premixture of the individual components of the agent and this is converted in customary manner into a pourable product. Thereby the above-defined aluminum silicate is employed in the form of the suspension of the invention. The suspension of the invention can be processed according to any known process for the production of solid, pourable washing and cleaning agents.

Especially in the production of powdery, pourable washing and cleaning agents the procedure is such that a suspension of the invention, for example from a supply container, is mixed with at least a washing, bleaching or cleaning component of the agent to be produced and the mixture subsequently converted into the powdery product according to any desired process. Advantageously a complexing component is added, i.e. a compound which has the capability of binding as complexes the alkaline earth metal ions responsible for water hardness, especially magnesium and calcium ions.

In the production of washing and cleaning agents there are different variants.

For example, the suspension of the invention can be combined with materials capable of binding water of crystallization. Suitably this is carried out by spraying the suspension on the compound capable of binding water of crystallization which compound is present in a mixture so that with continuous thorough mixing finally there is obtained a solid, dry appearing product. However, preferably the suspension of the invention is mixed with at least one additional washing, bleaching or cleaning compound in the form of a "slurry" and subjected to atomizing drying. Hereby there appear further surprising advantages of the claimed aluminum silicate suspension. It has proven in adding the suspension of the invention in the atomizing drying there can be obtained very low dust products. The products obtained by atomizing drying have a high calcium binding power and have good wettability.

Washing agents which are produced using the above-described suspension can be compounded in various manners. In general they contain at least one water soluble tenside present in the claimed aluminum silicate suspension and which does not belong to the dispersing agents of the invention. Besides they contain at least one further compound having washing, bleaching or cleaning action and which is inorganic or organic, as calcium binding compound an aluminum silicate as defined above. Furthermore, there can be present other customary adjuvants and additives, for the most part in small amount, which are used in these types of agents.

The compositions can comprise, consist essentially of, or consist of the stated materials and the process can comprise, consist essentiall of or consist of the recited steps with such materials.

Unless otherwise indicated all parts and percentages are by weight.

DETAILED DESCRIPTION

EXAMPLES

There was used a zeolite filter cake produced according to German Patent OS No. 2651485 and related Strack U.S. Pat. No. 4,303,629 (See Example 1). The powdery zeolite of Type A obtained thereby has the particle spectrum recited therein.

The zeolite A filter cake (component A) was stirred with a Dissolver and subsequently tempered in a 50 liter vessel at 45° C. The stabilizer (component B) was stirred in there at 75–76 rpm with a MlG 15' stirrer, whereby the temperature of the slurry increased to 50° C.

There were employed the following materials as stabilizer (component B). The turbidity point of these stabilizers was determined according to DIN 53917 (German Industrial Standard 53917) page 3, item 8.2 10% in 25% butyldiglcol solution (BDG solution).

1. Ethoxylate A
   Isotridecyl alcohol ethoxylate 5 mole EO
   Turbidity point 58° C.
   Solidification point 0±4° C.
   Viscosity at 50° C. 17±4 m Pas
   Density 50° C. 0.95 g/ml
2. Ethoxylate B
   Isotridecyl alcohol ethoxylate 5 mole EO
   Turbidity point 57° C.
   Solidification point −21±4° C.
   Viscosity at 50° C. 24±4 m Pas
   Density at 50° C. 0.95 g/ml
3. Ethoxylate C
   Isotridecyl alcohol ethoxylate 6.5 mole EO
   Turbidity point 67° C.
   Solidification point −12±4° C.
   Viscosity 50° C. 24±4 m Pas
   Density at 50° C. 0.97 g/ml
4. Ethoxylate D
   Isotridecyl alcohol ethoxylate 6.75 mole EO
   Turbidity point 68° C.
   Solidification −1±4° C.
   Viscosity at 50° C. 22±4 m Pas
   Density at 50° C. 0.97 g/ml
5. Ethoxylate E
   Isotridecyl alcohol ethoxylate 8 mole EO
   Turbidity point 73° C.
   Solidification point +12±4° C.
   Viscosity at 50° C. 23±4 m Pas
   Density at 50° C. 0.98 g/ml
6. Ethoxylate F
   Isotridecyl alcohol ethoxylate 8 mole EO
   Turbidity point 74° C.
   Solidification point −4±4° C.
   Viscosity at 50° C. 24±4 m Pas
   Density at 50° C. 0.97 g/ml For comparison purposes there were carried out additional comparison experiments with the following isotridecyl alcohol ethoxylates. These ethoxylate differ from the ethoxylates employed in the invention above all in their degree of ethoxylation and in their turbidity point:

7. Ethoxylate G
   Isotridecyl alcohol ethoxylate 6 mole EO
   Turbidity point 63° C.
   Solidification point −5±4° C.
   Viscosity at 50° C. 18±4 m Pas
   Density at 50° C. 0.96 g/ml
8. Ethoxylate H
   Isotridecyl alcohol ethoxylate 6 mole EO
   Turbidity point 64° C.
   Solidification point −14±4° C.
   Viscosity at 50° C. 20±4 m Pas
   Density at 50° C. 0.95 g/ml
9. Ethoxylate I
   Isotridecyl alcohol ethoxylate 3 mole EO
   Turbidity point 36° C.
   Solidification point −8±4° C.
   Viscosity at 50° C. 12±4 m Pas
   Density at 50° C. 0.92 g/ml
10. Ethoxylate K
    Isotridecyl alcohol ethoxylate 3 mole EO
    Turbidity point 34° C.
    Solidification point $< -25°$ C.
    Viscosity at 50° C. 15±4 m Pas
    Density at 50° C. 0.90 g/ml
11. Ethoxylate L
    Isotridecyl alcohol ethoxylate 9 mole EO
    Turbidity point 78° C.
    Solidification point =2±4° C.
    Viscosity at 50° C. 27±4 m Pas
    Density at 50° C. 1.0 g/ml After long storage at a constant temperature the suspensions obtained were evaluated in regard to the clear phase over the settled solids, the homogeneity, the flow behavior and the sediment. The results are set forth in the following table:

Examples 1 to 10 are examples according to the invention
Examples 11–22 are comparison examples.

| Stabilizer | (1) 200 g Insertion Ethoxylate A + D | (2) 200 g Insertion Ethoxylate B + F | (3) 50 kg Insertion Ethoxylate A + D | (4) 50 kg Insertion Ethoxylate B + F | (5) 50 kg Insertion Ethoxylate B + C | (6) 50 kg Insertion Ethoxylate B + C | (7) 200 g Insertion Ethoxylate B + C | (8) 200 g Insertion Ethoxylate B + C |
|---|---|---|---|---|---|---|---|---|
| Concentration | 1.5% | 1.5% | 1.5% | 1.5% | 1.5% | 1.2% | 1.5% | 1.5% |
| Mixing Ratio | 1:1 | 1:1 | 1:1 | 7:3 | 1:1 | 1:1 | 6:4 | 4:6 |
| Storage Temperature | 22° C./45° C. | 22° C./45° C. | 22° C. | 22° C./45° C. | 22° C./ 45° C./8° C. | 22° C. | 22° C./45° C. | 22° C./45° C. |
| Service Life | 3 days | 3 days | 3/7/10/14 days | 3 days | 3 days | 7 days | 3 days | 3 days |
| Clear Phase mm | 0/0 | 1/1 | 0/0/0/0 | 0/0 | 0/0/0 | 0 | 2/3 | 1/3 |
| Homogeneity | 1/1 | 3/3 | 1/1/1/1 | 2/1 | 1/2/1 | 2 | 2/2 | 2/2 |
| Flow Behavior | 1/1 | 2/2 | 1/2/2/2 | 2/1 | 1/1/1 | 2 | 1/1 | 1/1 |
| Sediment mm | 0/0 | 0/0 | 0/2/2/2 | 1/0 | 0/0/0 | 0 | 0/0 | 0/2 |

| Stabilizer | (9) 200 g Insertion Ethoxylate B + C | (10) 200 g Insertion Ethoxylate B + C | (11) 200 g Insertion Ethoxylate A + I | (12) 300 g Insertion Ethoxylate A + G | (13) 200 g Insertion Ethoxylate G + D | (14) 200 g Insertion Ethoxylate D + E | (15) 200 g Insertion Ethoxylate H + L | (16) 50 kg Insertion Ethoxylate B + L |
|---|---|---|---|---|---|---|---|---|
| Concentration | 1.5% | 1.5% | 1.5% | 1.5% | 1.5% | 1.5% | 1.5% | 1.5% |
| Mixing Ratio | 3:7 | 2:8 | 1:1 | 1:1 | 1:1 | 1:1 | 1:1 | 1:1 |
| Storage Temperature | 22° C./45° C. | 22° C./45° C. | 22° C. | 22° C./45° C. | 22° C./45° C. | 22° C./45° C. | 22° C./45° C. | 22° C./8° C. |
| Service Life | 3 days | 3 days | 3 days | 3 days | 3 days | 3 days | 3 days | 3 days |
| Clear Phase mm | 0/2 | 0/2 | 3 | 2/2 | 3/1 | 4/2 | 6/2 | 2/5 |
| Homogeneity | 1/2 | 1/1 | 5 | 4/4 | 4/3 | 4/3 | 4/3 | 3/3 |
| Flow Behavior | 1/1 | 1/1 | 5 | 4/4 | 4/2 | 4/2 | 4/2 | 3/4 |
| Sediment mm | 0/0 | 0/0 | — | 0/2 | 15/2 | 0/01 | 1/3 | 20/20 |

| Stabilizer | (17) 200 g Insertion Ethoxylate G | (18) 200 g Insertion Ethoxylate A | (19) 200 g Insertion Ethoxylate E | (20) 200 g Insertion Ethoxylate D | (21) 200 g Insertion Ethoxylate B | (22) 200 g Insertion Ethoxylate F |
|---|---|---|---|---|---|---|
| Concentration | 1.4% | 1.5% | 1.5% | 1.5% | 1.5% | 1.5% |
| Storage Temperature | 22° C./45° C. | 22° C./45° C. | 22° C./45° C. | 22° C./45° C. | 22° C./45° C. | 22° C./45° C. |
| Service Life | 3 days | 3 days | 3 days | 3 days | 3 days | 3 days |
| Clear Phase mm | 4/4 | 5/5 | 4/4 | 5/2 | 3/3 | 5/5 |
| Homogeneity | 4/4 | 5/5 | 5/5 | 5/3 | 4/4 | 4/5 |
| Flow Behavior | 4/4 | 5/5 | 5/4 | 5/3 | 4/4 | 4/5 |
| Sediment mm | 2/2 | —/— | —/0 | 2 | 3/12 | 0/— |

Viscosity

A suspension with Nonylphenol ethoxylate stabilized according to German Patent OS No. 32 09 631, Exadmples 23–25 has the viscosity:

at 22° C. of 288 m Pas
at 15° C. of 766 m Pas
at 10° C. of 1688 m Pas

Suspension according to Example (5) or (6) of the present invention has a viscosity:

at 40° C. of 143 m Pas
at 20° C. of 146 m Pas
at 10° C. of 173 m Pas

There was ascertained nearly no change in viscosity.

Results:

The suspension of the invention in comparison to the state of the art advantageously has a clearly lower viscosity.

Of especial advantage is the fact that the lower viscosity also remains practically unchanged at low temperature.

The entire disclosure of German priority application P No. 3444311.8 is hereby incorporated by reference.

What is claimed is:

1. An aqueous pumpable, stable suspension of a water insoluble silicate capable of binding calcium ions which contains a dispersing component which contains in addition to water based on the total weight of the aqueous suspensions, (A) as water insoluble silicate capable of binding calcium 0.5 to 70 weight % of a finely divided, bound water containing, synthetically produced, water insoluble crystalline compound of the formula:

$$(Cat_2/_nO)_x—Me_2O_3\cdot(SiO_2)_y \qquad \text{I}$$

in which Cat is a cation of valence n exchangeable with calcium, x is a number from 0.7 to 1.5, Me is boron or aluminum and y is a number from 0.8 to 6, and (B) as a dispersing component in an amount of 0.5 to 6 weight percent a mixture of at least two different fatty alcohol polyglycol ethers based on isotridecyl alcohol or another aliphatic $C_{13}$ alcohol and ethylene oxide having the following properties:

(a) Fatty alcohol polyglycol ether having 4.5 to 5.5 EO Units

| | |
|---|---|
| Turbidity point DIN 53917 | 56 to 60° C. |
| Solidification point | +4 to −25° C. |
| Viscosity at 50° C. | 13 to 28 m Pas |
| Density at 50° C. | 0.94 to 0.96 g/ml |

(b) Fatty alcohol polyglycol ether having 6 to 8 EO Units

| | |
|---|---|
| Turbidity point DIN 53917 | 66 to 74° C. |
| Solidification point | +12 to −16° C. |
| Viscosity at 50° C. | 18 to 28 m Pas |
| Density at 50° C. | 0.96 to 0.98 g/ml, |

each of the fatty alcohol polyglycol ethers being present in amount sufficient to increase the stability of the suspension over the stability obtained using only one of the fatty alcohol polyglycol ethers, there being present at least one ether from group (a) and at least one ether from group (b).

2. A suspension according to claim 1 wherein component (B) is made of at least two different isotridecyl alcohol polyethylene glycol ethers.

3. A suspension according to claim 1 wherein Component A is crystalline.

4. A suspension according to claim 2 wherein Component A is crystalline.

5. A suspension according to claim 3 wherein in Formula I y is a number from 1.3 to 4.

6. A suspension according to claim 4 wherein in Formula I y is a number from 1.3 to 4.

7. A suspension according to claim 2 wherein in Formula I y is a number from 1.3 to 4.

8. A suspension according to claim 1 wherein in Formula I y is a number from 1.3 to 4.

9. A suspension according to claim 8 wherein Component A is a zeolite A.

10. A suspension according to claim 7 wherein Component A is a zeolite A.

11. A suspension according to claim 6 wherein Component A is a zeolite A.

12. A suspension according to claim 5 wherein Component A is a zeolite A.

13. A suspension according to claim 4 wherein Component A is a zeolite A.

14. A suspension according to claim 3 wherein Component A is a zeolite A.

15. A suspension according to claim 2 wherein Component A is a zeolite A.

16. A suspension according to claim 1 wherein Component A is a zeolite A.

17. A suspension according to claim 1 wherein component B is a mixture of two differnt fatty alcohols wherein the ratio of ether (a) to ether (b) is from 7:3 to 2:8.

18. A suspension according to claim 17 wherein component (B) is made of two different isotridecyl alcohol polyethylene glycol ethers.

19. A suspension according to claim 18 wherein component A is crystalline and in formula I y is a number from 1, 3 to 4.

20. A suspension according to claim 19 wherein component A is a zeolite A.

* * * * *